US011641883B2

(12) United States Patent
Qiu et al.

(10) Patent No.: US 11,641,883 B2
(45) Date of Patent: May 9, 2023

(54) ELECTRONIC CIGARETTE CONTROL METHOD AND ELECTRONIC CIGARETTE

(71) Applicant: JOYETECH EUROPE HOLDING GMBH, Zug (CH)

(72) Inventors: Weihua Qiu, Changzhou (CN); Rufeng You, Changzhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 573 days.

(21) Appl. No.: 16/643,558

(22) PCT Filed: Aug. 3, 2018

(86) PCT No.: PCT/CN2018/098448
§ 371 (c)(1),
(2) Date: Feb. 29, 2020

(87) PCT Pub. No.: WO2019/042081
PCT Pub. Date: Mar. 7, 2019

(65) Prior Publication Data

US 2020/0196671 A1 Jun. 25, 2020

(30) Foreign Application Priority Data

Aug. 30, 2017 (CN) ..... 201710764288.3

(51) Int. Cl.

| | |
|---|---|
| ***A24F 40/53*** | (2020.01) |
| ***A24F 40/40*** | (2020.01) |
| ***A24F 40/51*** | (2020.01) |
| ***A24F 40/60*** | (2020.01) |
| *A24F 40/10* | (2020.01) |

(52) U.S. Cl.
CPC ..... *A24F 40/53* (2020.01); *A24F 40/40* (2020.01); *A24F 40/51* (2020.01); *A24F 40/60* (2020.01); *A24F 40/10* (2020.01)

(58) Field of Classification Search
CPC ..... A24F 40/50; A24F 40/51; A24F 40/53; A24F 40/60
See application file for complete search history.

(56) References Cited

U.S. PATENT DOCUMENTS

| | | | | |
|---|---|---|---|---|
| 2014/0123989 | A1 | 5/2014 | Lamothe | |
| 2014/0334804 | A1 | 11/2014 | Choi | |
| 2017/0048928 | A1* | 2/2017 | Gorilovsky | F22B 37/38 |

FOREIGN PATENT DOCUMENTS

| | | | |
|---|---|---|---|
| CN | 203676125 | U | 7/2014 |
| CN | 204012951 | U | 12/2014 |

(Continued)

*Primary Examiner* — Hae Moon Hyeon
(74) *Attorney, Agent, or Firm* — Cheng-Ju Chiang

(57) ABSTRACT

An electronic cigarette control method and an electronic cigarette are provided. The method includes: acquiring the characteristic parameter of the atomizer of the electronic cigarette; determining the first output power corresponding to the characteristic parameter of the atomizer; and outputting electric energy to the atomizer with the first output power when a smoking signal is detected. The electronic cigarette can output electric energy of different powers to atomizers with different specifications, so that the battery device of the electronic cigarette can be adapted to atomizers with different specifications, thereby increasing the adaptation range of the electronic cigarette.

7 Claims, 6 Drawing Sheets

(56) References Cited

FOREIGN PATENT DOCUMENTS

| | | | |
|---|---|---|---|
| CN | 104886780 | A | 9/2015 |
| CN | 106037007 | A | 10/2016 |
| CN | 106037021 | A | 10/2016 |
| CN | 106418702 | A | 2/2017 |
| CN | 206043428 | U | 3/2017 |
| CN | 106579563 | A | 4/2017 |
| EP | 2399636 | A1 | 12/2011 |
| GB | 2542926 | A | 4/2017 |
| WO | 2015/022448 | A1 | 2/2015 |

* cited by examiner

ELECTRONIC CIGARETTE CONTROL METHOD AND ELECTRONIC CIGARETTE

CROSS REFERENCE TO RELATED APPLICATION

This application is a 35 U.S.C. § 371 National Phase conversion of International (PCT) Patent Application No. PCT/CN2018/098448, filed on Aug. 3, 2018, which claims the priority of Chinese Patent Application No. 201710764288.3, filed on Aug. 30, 2017. The contents of the above-identified applications are incorporated herein by reference. The PCT International Patent Application was filed and published in Chinese.

TECHNICAL FIELD

The present invention relates to the technical field of electronic cigarettes, and in particular, to an electronic cigarette control method and an electronic cigarette.

BACKGROUND

An electronic cigarette is an electronic product that uses an atomizer to atomize e-liquid containing substances such as nicotine to produce the same smoke, taste, and feel as a cigarette.

In the related art, after a user turns on a switch in an electronic cigarette, a power control circuit in the electronic cigarette outputs electric energy to the atomizer at a preset fixed output power, and the atomizer atomizes the cigarette oil through the electric energy output by the power control circuit, to generate smoke for the user to inhale.

Atomizers in electronic cigarettes are usually removable and replaceable. There are many types of atomizers on the market. In the related art, the output power of the power control circuit to output electric energy to the atomizer is fixed, resulting in that the battery device in an electronic cigarette cannot be used with atomizers of different types.

SUMMARY

In order to solve the problems of the related art, embodiments of the present invention provide an electronic cigarette control method and an electronic cigarette. The technical solution is as follows:

In a first aspect, an electronic cigarette control method is provided. The method includes:

acquiring the characteristic parameter of the atomizer of the electronic cigarette;

determining the first output power corresponding to the characteristic parameter of the atomizer; and outputting electric energy to the atomizer with the first output power when a smoking signal is detected.

Optionally, the characteristic parameter includes at least one of: the atomizer type, the liquid inlet amount of the atomizer, the air inlet amount of the atomizer, the resistance type of the heating element of the atomizer, and the resistance value of the heating element of the atomizer.

Optionally, the characteristic parameter includes the atomizer type and a first parameter, and the first parameter includes at least one of: the liquid inlet amount of the atomizer, the air inlet amount of the atomizer, the resistance type of the heating element of the atomizer, and the resistance value of the heating element of the atomizer; wherein acquiring the characteristic parameter of the atomizer of the electronic cigarette, includes:

receiving an input of the atomizer type; and querying the first parameter according to the relationship between the atomizer type and the first parameter.

Optionally, when the characteristic parameter includes the resistance type of the heating element of the atomizer and the resistance value of the heating element of the atomizer, acquiring the characteristic parameter of the atomizer of the electronic cigarette, includes:

identifying the resistance type of the heating element of the atomizer, and measuring the resistance value of the heating element of the atomizer.

Optionally, identifying the resistance type of the heating element of the atomizer includes:

measuring the resistivity of the heating element of the atomizer; and determining the resistance type of the heating element of the atomizer based on the measured resistivity according to the preset relationship between the resistivity and the resistance type.

Optionally, determining the first output power for outputting to the atomizer according to the characteristic parameter of the atomizer, includes:

determining the correlation groups corresponding to the resistance type of the heating element of the atomizer, wherein there is a relationship between the resistance value of the heating element of the atomizer and the output power in the correlation groups;

querying from the correlation groups to determine the first output power corresponding to the resistance value of the heating element of the atomizer.

Optionally, the method further includes:

displaying the resistance type of the heating element of the atomizer after the resistance type of the heating element of the atomizer is identified;

displaying an interface for resetting the resistance type of the heating element of the atomizer when an operation for resetting the resistance type is received;

acquiring the new resistance type that is reset in the interface for resetting the resistance type of the heating element of the atomizer; and replacing the resistance type of the heating element of the atomizer with the new resistance type.

Optionally, the method further includes:

when an adjustment operation of adjusting the output power is received, acquiring the second output power in response to the adjustment operation; and outputting electric energy to the atomizer with the second output power.

Optionally, the method further includes:

setting the second output power as the new first output power corresponding to the characteristic parameter of the atomizer Optionally, the method further includes:

counting the adjustment operations of the output power of the atomizer corresponding to the characteristic parameter within a preset period of time; and setting the new first output power corresponding to the characteristic parameter of the atomizer according to the counted adjustment operations.

Specifically, among the second output powers corresponding to the output power adjustment operations of the atomizer according to the characteristic parameter, the output power being adjusted most times in a preset period of time is set as the new first output power.

Or, among the second output powers corresponding to the output power adjustment operations of the atomizer according to the characteristic parameter, the output power with the longest use time in a preset period of time is set as the new first output power.

Optionally, before determining the first output power corresponding to the characteristic parameter of the atomizer, the method further includes:

determining whether the characteristic parameter of the atomizer is within a preset parameter range;

performing the step of determining the first output power corresponding to the characteristic parameter of the atomizer if the characteristic parameter of the atomizer is within the preset parameter range.

Optionally, the method further includes:

displaying a first prompt message to indicate that the atomizer does not match the battery device of the electronic cigarette when the characteristic parameter of the atomizer is greater than the preset parameter range; and displaying a second prompt message to indicate that the atomizer is not installed correctly when the characteristic parameter of the atomizer is smaller than the preset parameter range.

In a second aspect, an electronic cigarette is provided. The electronic cigarette includes:

a parameter acquiring module, configured to acquire the characteristic parameter of the atomizer of the electronic cigarette;

a power determining module, configured to determine the first output power corresponding to the characteristic parameter of the atomizer; and an output module, configured to output electric energy to the atomizer with the first output power when a smoking signal is detected.

Optionally, the characteristic parameter includes at least one of: the atomizer type, the liquid inlet amount of the atomizer, the air inlet amount of the atomizer, the resistance type of the heating element of the atomizer, and the resistance value of the heating element of the atomizer.

Optionally, when the characteristic parameter includes the atomizer type and a first parameter, the parameter acquiring module is configured to receive an input of the atomizer type and then query the first parameter according to the relationship between the atomizer type and the first parameter, wherein the first parameter includes at least one of: the liquid inlet amount of the atomizer, the air inlet amount of the atomizer, the resistance type of the heating element of the atomizer, and the resistance value of the heating element of the atomizer.

Optionally, when the characteristic parameter includes the resistance type of the heating element of the atomizer and the resistance value of the heating element of the atomizer, the parameter acquiring module is configured to identify the resistance type of the heating element of the atomizer and measure the resistance value of the heating element of the atomizer.

Optionally, when identifying the resistance type of the heating element of the atomizer, the parameter acquiring module is configured to firstly measure the resistivity of the heating element of the atomizer, and then determine the resistance type of the heating element of the atomizer based on the measured resistivity according to the preset relationship between the resistivity and the resistance type.

Optionally, the power determining module is configured to determine the correlation groups corresponding to the resistance type of the heating element of the atomizer and then query from the correlation groups to determine the first output power corresponding to the resistance value of the heating element of the atomizer, wherein there is a relationship between the resistance value of the heating element of the atomizer and the output power in the correlation groups.

Optionally, the electronic cigarette further includes:

a first display module, configured to display the resistance type of the heating element after the resistance type of the heating element of the atomizer is identified;

a second display module, configured to display an interface for resetting the resistance type of the heating element of the atomizer when an operation for resetting the resistance type is received;

a type acquiring module, configured to acquire the new resistance type that is reset in the interface for resetting the resistance type of the heating element of the atomizer; and a replacing module, configured to replace the resistance type of the heating element of the atomizer with the new resistance type.

Optionally, the electronic cigarette further includes:

a power acquiring module, configured for acquiring the second output power corresponding to the adjustment operation when an adjustment operation of adjusting the output power is received;

wherein:

the output module is further configured for outputting electric energy to the atomizer with the second output power acquired by the power acquiring module.

Optionally, the electronic cigarette further includes:

an operation counting module, configured to count the adjustment operations of the output power of the atomizer corresponding to the characteristic parameter within a preset period of time;

and a second setting module, configured to set the new first output power corresponding to the characteristic parameter of the atomizer according to the adjustment operations counted by the operation counting module.

Optionally, the second setting module is configured to:

set the output power being adjusted most times in a preset period of time as the new first output power from the second output powers corresponding to the output power adjustment operations of the atomizer according to the characteristic parameter, or, set the output power with the longest use time in a preset period of time as the new first output power from the second output powers corresponding to the output power adjustment operations of the atomizer according to the characteristic parameter.

Optionally, the electronic cigarette further includes:

a judging module, configured for determining whether the characteristic parameter of the atomizer is within a preset parameter range before the power determining module determines the first output power corresponding to the characteristic parameter of the atomizer; wherein:

the power determining module is configured to perform the step of determining the first output power corresponding to the characteristic parameter of the atomizer when the characteristic parameter of the atomizer is within the preset parameter range.

Optionally, the electronic cigarette further includes:

a first prompt module, configured to display a first prompt message to indicate that the atomizer does not match the battery device of the electronic cigarette when the characteristic parameter of the atomizer is greater than the preset parameter range; and a second prompt module, configured to display a second prompt message to indicate that the atomizer is not installed correctly when the characteristic parameter of the atomizer is smaller than the preset parameter range.

In a third aspect, an electronic cigarette control device is provided. The electronic cigarette control device includes:

a memory and a processor;

wherein the memory stores therein at least one instruction; and the processor, by loading and executing the at least one instruction, implements the above electronic cigarette control method.

In a fourth aspect, a computer-readable storage medium is provided, wherein one or more instructions are stored in the computer-readable storage medium, when the one or more instructions are executed by the processor in an electronic cigarette, the above electronic cigarette control method is performed.

The beneficial effects brought by the technical solutions provided by the embodiments of the present invention are as follows:

By acquiring the characteristic parameter of the atomizer in the electronic cigarette, the output power of electric energy outputted to the atomizer is determined according to the relationship between the characteristic parameter of the atomizer and the output power, and then the determined output power of electric energy is outputted to the atomizer. That is, the electronic cigarette can output different power of electric energy to atomizers with different characteristic parameters, so that the battery device of the electronic cigarette can be adapted to atomizers with different specifications, to thereby improve the adaptation range of the electronic cigarette.

BRIEF DESCRIPTION OF THE DRAWINGS

In order to more clearly illustrate the technical solutions in the embodiments of the present invention, the drawings used in the description of the embodiments will be briefly described below. It is obvious that the drawings in the following description are only some embodiments of the present invention. For those of ordinary skill in the art, other drawings may also be obtained in light of these drawings without any creative efforts.

DETAILED DESCRIPTION OF PREFERRED EMBODIMENTS

In order to make the objects, the technical solution and the advantages of the present invention much clear, the embodiments of the present invention will be further described in detail below with reference to the accompanying drawings.

Figure 1:
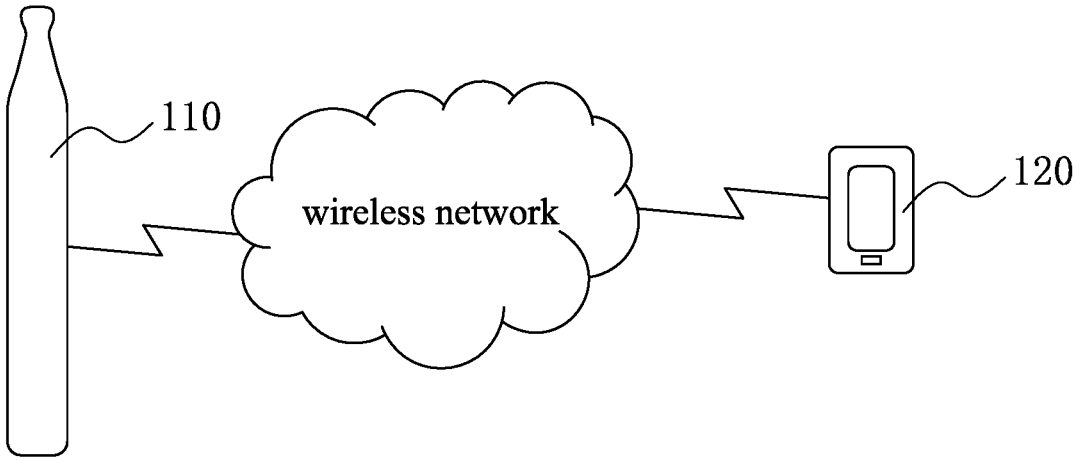
FIG. 1 is a schematic diagram of an implementation environment involved in various embodiments of the present invention.

Referring to FIG. 1, it illustrates a schematic diagram of an implementation environment involved in various embodiments of the present invention. As shown in FIG. 1, the implementation environment may include an electronic cigarette 110 and a mobile terminal 120. The electronic cigarette 110 and the mobile terminal 120 may be connected through a wireless network. Optionally, the electronic cigarette 110 and the mobile terminal 120 may also be connected through wires.

Figure 2:
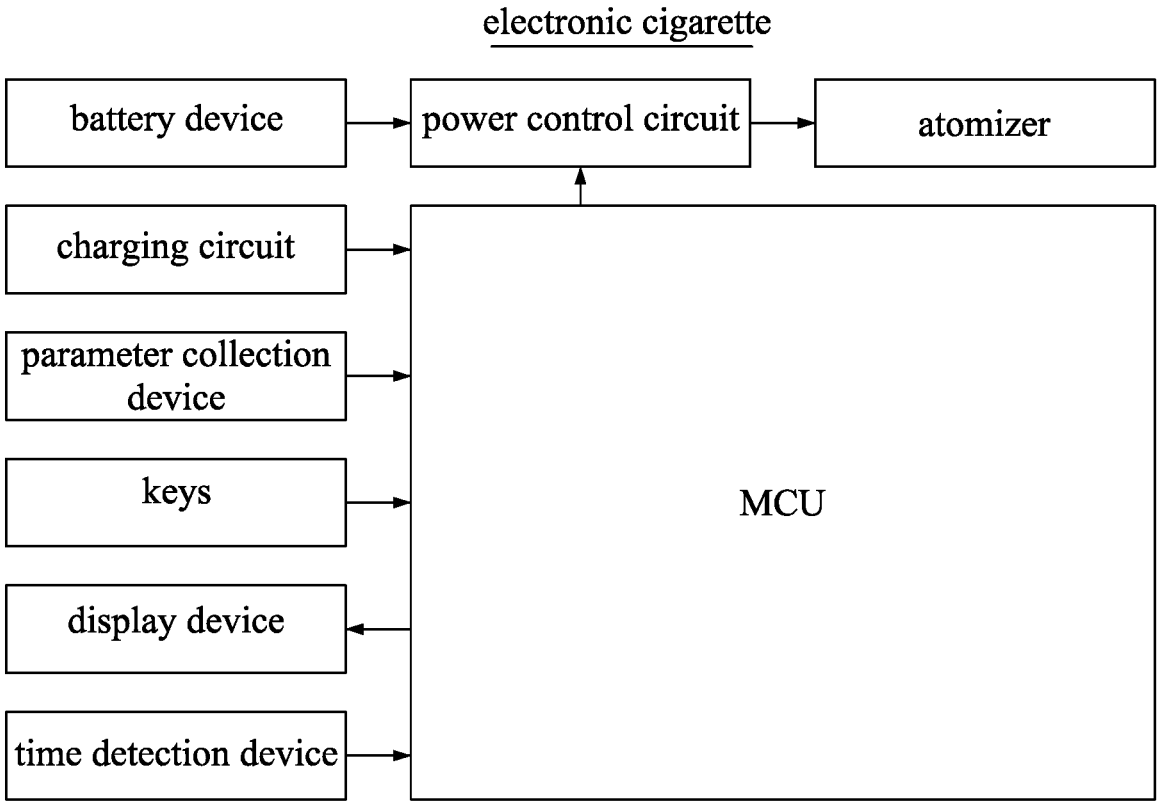
FIG. 2 is a schematic structural diagram of an electronic cigarette according to an embodiment of the present invention.

As shown in FIG. 2, the electronic cigarette 110 may include an MCU (microcontroller unit), an atomizer, a power control circuit, a battery device, a charging circuit, a parameter collection device, keys, a time detection device, and a display device.

The MCU is the control center of the electronic cigarette 110, and is used to control other components in the electronic cigarette 110.

The atomizer is used to atomize e-liquid, so as to generate smoke for the user to inhale. In the embodiments of the present invention, the atomizer is detachable, that is, as long as the interface type of the atomizer matches the interface type of the electronic cigarette, the atomizer can be installed to the electronic cigarette.

The power control circuit is used to control the output power of electric energy to the atomizer. Under normal circumstances, the greater the output power of electric energy output to the atomizer, the more the amount of smoke generated by the atomizer in a time period unit.

The battery device is used to energize the electronic cigarette 110, and optionally, the battery device is usually a lithium battery. In addition, in the embodiments of the present invention, the battery device may be a rechargeable battery or a non-rechargeable battery, which is not limited in the embodiments. The types of batteries in electronic cigarettes can be rechargeable or non-rechargeable batteries that can provide power, such as lithium batteries, alkaline dry batteries, nickel-metal hydride batteries, lead-acid batteries, iron-nickel batteries, metal oxide batteries, zinc-silver batteries, zinc-nickel batteries, hydrogen-oxygen fuel cells, solar cells, etc.

The charging circuit is the circuit used for charging the battery device.

The keys may be the keys in the electronic cigarette 110 for controlling the electronic cigarette 110 to be turned on or off. The keys may also be the keys for controlling the start or end of operation of the atomizer of the electronic cigarette 110, and may further be the keys for setting the working parameters of the electronic cigarette 110, such as time, working mode, working voltage, working power, etc. Optionally, the keys may be physical keys, virtual keys such as touch screen, or pressure keys, touch keys, etc., which are not limited in the embodiments.

The display device is the device used for displaying information of the electronic cigarette. Optionally, the display device may be a display screen or the like. The MCU can send the content to be displayed, such as the working mode, time, date of the electronic cigarette, to the display device for display.

Although not shown in the figures, in actual implementations, the electronic cigarette may further include other components, such as a communication device for communicating with other terminals, such as a WiFi (Wireless Fidelity) device, a Bluetooth device, an infrared device and so on. For further example, the electronic cigarette may further include a container for containing the e-liquid. In the embodiments, these are not repeatedly described. And, in actual implementations, two or more components in the electronic cigarette 110 may also be integrated into one. For example, the MCU, the power control circuit, the battery device, the charging circuit, the parameter collection device, the keys and the display device mentioned above can be integrated into the battery device, and specific structures are not limited in the embodiments.

The mobile terminal 120 may be a terminal such as a mobile phone, a tablet computer, or an electronic reader. The mobile terminal 120 may be connected to the electronic cigarette 110 through a wireless network. Optionally, an APP (application) corresponding to the electronic cigarette 110 may be installed in the mobile terminal 120, and the mobile terminal 120 is bound to the electronic cigarette 110 through the APP It should be noted that FIG. 1 is only illustrated by including both an electronic cigarette 110 and a mobile terminal 120 in the implementation environment. Optionally, the implementation environment may further include more or fewer terminals, for example, the mobile terminal 120 may not be included in the implementation environment, which is not limited in the embodiments.

In the above implementations, for different atomizers, the electronic cigarette 110 may control the power control circuit to output power to the atomizers.

Figure 3:
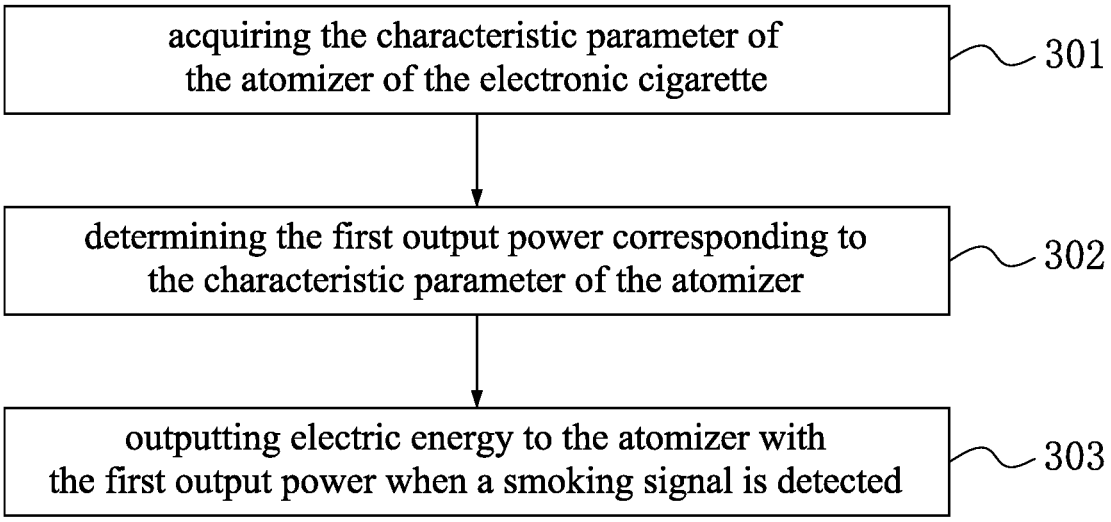
FIG. 3 is a flowchart of an electronic cigarette control method according to an embodiment of the present invention.

Referring to FIG. 3, it shows a flowchart of an electronic cigarette control method according to an embodiment of the present invention. In this embodiment, the electronic cigarette control method is used in the electronic cigarette shown in FIG. 1 as an example. As shown in FIG. 3, the electronic cigarette control method may include:

Step 301: acquiring the characteristic parameter of the atomizer of the electronic cigarette.

After the atomizer is connected to the battery device of the electronic cigarette, the electronic cigarette can acquire the characteristic parameter of the atomizer.

In the embodiments of the present invention, the characteristic parameter of an atomizer may include at least one of: the atomizer type, the liquid inlet amount of the atomizer, the air inlet amount of the atomizer, the resistance type of the heating element of the atomizer, and the resistance value of the heating element of the atomizer. The heating element of the atomizer may include, but is not limited to, any one of a heating sheet, a heating tube, and a resistance wire.

As a possible implementation manner, taking the characteristic parameter including the resistance type and the resistance value of the heating element of the atomizer as an example, the resistance type of the heating element of the atomizer includes: the resistivity of the heating element of the atomizer, the conductivity of the heating element of the atomizer, etc. For different characteristic parameters, the method of acquiring characteristic parameter is different.

When acquiring the characteristic parameter of the heating element of the atomizer of the electronic cigarette, the electronic cigarette can identify the resistance type of the heating element of the atomizer, and measure the resistance value of the heating element of the atomizer.

For example, the electronic cigarette can be provided with a current detection amplifier, which can measure the electric current and the voltage across the heating element of the atomizer. Optionally, the electronic cigarette can be provided with a current sensor and a voltage sensor, wherein the current sensor is used to measure the electric current across the heating element of the atomizer, and the voltage sensor is used to measure the voltage across the heating element of the atomizer. The above-mentioned measuring components (that is, the current detection amplifier or the current sensor and the voltage sensor) send the measuring results to the MCU (microcontroller unit). The MCU can calculate the resistance value of the heating element of the atomizer using the electric current and the voltage across the heating element of the atomizer.

When identifying the resistance type of the heating element of the atomizer, the electronic cigarette can firstly measure the resistivity of the heating element of the atomizer, and then determine the resistance type of the heating element of the atomizer based on the measured resistivity according to the preset relationship between the resistivity and the resistance type.

For further example, a memory may be provided in the atomizer, and the memory may store the resistance type and the resistance value of the heating element of the atomizer, and the atomizer type, etc., wherein the resistance type may include the resistivity and the conductivity, etc. Taking the resistivity of the heating element of the atomizer as an example when acquiring the characteristic parameter, after the atomizer is connected to the battery device of the electronic cigarette, the MCU of the electronic cigarette can read the resistivity of the heating element of the atomizer stored in the memory of the atomizer.

As another possible implementation manner, taking the characteristic parameter including the atomizer type and a first parameter as an example, wherein the first parameter includes but is not limited to at least one of: the liquid inlet amount of the atomizer, the air inlet amount of the atomizer, the resistance type of the heating element of the atomizer, and the resistance value of the heating element of the atomizer. After the user connects the atomizer to the battery device of the electronic cigarette, the user can manually input the atomizer type to the electronic cigarette and then query the first parameter according to the relationship between the atomizer type and the first parameter.

Figure 4:
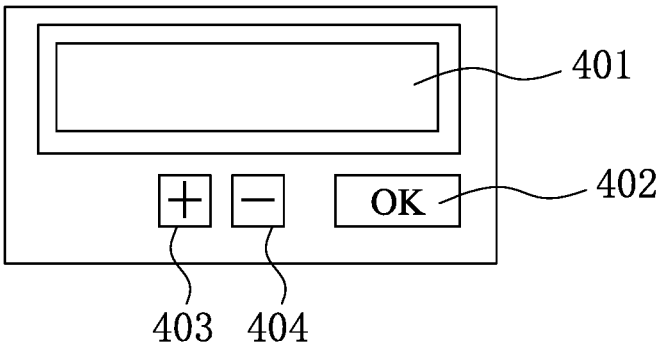
FIG. 4 is a schematic structural diagram of a display screen of the electronic cigarette with the keys according to the embodiment shown in FIG. 3.

Referring to FIG. 4, it is a schematic structural diagram of a display screen of the electronic cigarette and the keys according to an embodiment of the present invention. The display screen 401 can display the atomizer type. The bottom of the display screen 401 includes at least one physical key, which is shown in FIG. 4 as a key 402 ([OK] key), a key 403 ([+] key), and a key 404 ([−] key).

After the atomizer is connected to the battery device of the electronic cigarette, the MCU, when getting this connection signal, controls the display screen 401 to display an interface for selecting the atomizer type. The interface displays various optional atomizer types. The user can use [+] Key (key 403) or [-] key (key 404) to select the correct atomizer type, and use the [OK] key (key 402) to send the correct atomizer type to the MCU. The MCU can query the parameters corresponding to the correct atomizer type, such as the liquid inlet amount of the atomizer, the air inlet amount of the atomizer, the resistance type of the heating element of the atomizer, and the resistance value of the heating element of the atomizer according to a pre-stored relationship, wherein the pre-stored relationship between the atomizer type and the parameters such as the liquid inlet amount of the atomizer, the air inlet amount of the atomizer, the resistance type of the heating element of the atomizer, and the resistance value of the heating element of the atomizer can be stored in the MCU of the electronic cigarette in the form of a table.

Step 302: determining the first output power corresponding to the characteristic parameter of the atomizer.

Optionally, the electronic cigarette may query a preset initial output power table stored in the MCU corresponding to the characteristic parameter of the atomizer according to the relationship between the characteristic parameter of the atomizer and the output power. Optionally, in the above-mentioned relationship, one characteristic parameter may correspond to one output power; or, multiple characteristic parameters may correspond to one output power.

For example, taking the characteristic parameter including the resistance type and the resistance value of the heating element of the atomizer as an example, when determining the first output power for outputting to the atomizer according to the characteristic parameter of the atomizer, the MCU determines the correlation groups between the resistance value of the heating element of the atomizer and the output power, so that the first output power corresponding to the resistance value of the heating element of the atomizer is queried and determined from the correlation groups.

The correlation groups may be stored in the form of a table in the MCU of the electronic cigarette.

For example, by taking the resistance value of the heating element of the atomizer as an example, please refer to Table 1, it shows a possible relationship. As shown in Table 1, in this relationship, the heating element of the atomizer is a notch coil type. When the resistance value of the heating element is 0.25Ω, the corresponding output power is 45W. When the resistance value of the heating element is 0.68Ω, the corresponding output power is 35W. When the resistance value of the heating element is 0.755Ω, the output power is 30W. The specific values of the resistance value and the output power are not limited in this embodiment. The relationship between the resistance value and the output power in this embodiment is only for illustration. The relationship between the resistance value and the output power in actual products can be obtained based on experimental data results of the R&D personnel for different products.

TABLE 1

| Notch Coil | |
|---|---|
| resistance value | output power |
| 0.25 | 45 W |
| 0.68 | 35 W |
| 0.75 | 30 W |

Referring to Table 2, it shows a possible relationship. As shown in Table 2, in this relationship, the heating element of the atomizer is a BF type. When the resistance value of the heating element is 0.5Ω, the corresponding output power is 30W. When the resistance value of the heating element is 0.6Ω, the corresponding output power is 28W. When the resistance value of the heating element is 1.0Ω, the output power is 25W. When the resistance value of the heating element is 1.5Ω, the output power is 20W. The specific values of the resistance value and the output power are not limited in this embodiment.

TABLE 2

| BF | |
|---|---|
| resistance value | output power |
| 0.5 | 30 W |
| 0.6 | 28 W |
| 1.0 | 25 W |
| 1.5 | 20 W |

The above-mentioned relationship between the characteristic parameter and the output power may be preset in the electronic cigarette, or customized by the user in the electronic cigarette, or customized by the user through the APP in the mobile terminal and then sent to the electronic cigarette, which is not limited in this embodiment.

It should be noted that Table 1 and Table 2 in the above only use the relationship between the resistance value of the heating element of the atomizer and the output power stored in the MCU as an example for illustration. In actual implementations, the resistance value of the heating element of the atomizer can also be replaced with other parameters, such as the liquid inlet amount of the atomizer or the air inlet amount of the atomizer.

For example, please refer to Table 3, it shows a possible relationship between the liquid inlet amount of the atomizer and the first output power.

TABLE 3

| BF | |
|---|---|
| liquid inlet amount | output power |
| 0.1 g | 20 W |
| 0.12 g | 25 W |
| 0.13 g | 28 W |
| 0.15 g | 30 W |

As shown in Table 3, in the relationship, the atomizer type is BF. When the liquid inlet amount of the atomizer is 0.1 g, the corresponding output power is 20 W. When the liquid inlet amount of the atomizer is 0.12 g, the corresponding output power is 25 W. When the liquid inlet amount of the atomizer is 0.13 g, the corresponding output power is 28 W. When the liquid inlet amount of the atomizer is 0.15 g, the corresponding output power is 30 W. The specific values of the liquid inlet amount of the atomizer and the output power are not limited in this embodiment. The relationship between the liquid inlet amount of the atomizer and the output power in this embodiment are only for illustration. The relationship between the liquid inlet amount of the atomizer and the output power in actual products can be obtained based on experimental data results of the R&D personnel for different products.

Alternatively, please refer to Table 4, it shows a possible relationship between the liquid air inlet amount of the atomizer and the first output power.

TABLE 4

| BF | |
|---|---|
| air inlet amount | output power |
| 100 ml | 20 W |
| 130 ml | 25 W |

TABLE 4-continued

| BF | |
|---|---|
| air inlet amount | output power |
| 150 ml | 28 W |
| 200 ml | 30 W |

As shown in Table 4, in the relationship, the atomizer type is BF. When the air inlet amount of the atomizer is 100 ml, the corresponding output power is 20 W. When the air inlet amount of the atomizer is 130 ml, the corresponding output power is 25 W. When the air inlet amount of the atomizer is 150 ml, the corresponding output power is 28 W. When the air inlet amount of the atomizer is 200 ml, the corresponding output power is 30 W. The specific values of the air inlet amount of the atomizer and the output power are not limited in this embodiment. The relationship between the air inlet amount of the atomizer and the output power in this embodiment are only for illustration. The relationship between the air inlet amount of the atomizer and the output power in actual products can be obtained based on experimental data results of the R&D personnel for different products.

Step 303: outputting electric energy to the atomizer with the first output power when a smoking signal is detected.

The MCU of the electronic cigarette instructs the power control circuit to control the battery device of the electronic cigarette to output electric energy to the heating element of the atomizer with the first output power, so that the e-liquid in the atomizer is atomized to generate smoke.

When the electronic cigarette performs step 301 and step 302, the output power determined according to the characteristic parameter of the atomizer and the initial output power table is the first output power determined in step 302. However, when step 301 and step 302 are not performed, the initial output power can be the preset output power in the electronic cigarette, or the output power of the atomizer when the electronic cigarette was last used, or the output power of the longest use time of the electronic cigarette, which is not limited in this embodiment.

In conclusion, in the electronic cigarette control method provided in this embodiment, by acquiring the characteristic parameter of the atomizer in the electronic cigarette, the output power of electric energy outputted to the atomizer is determined according to the relationship between the characteristic parameter of the atomizer and the output power, and then the determined output power of electric energy is outputted to the atomizer. That is, the electronic cigarette can output different power of electric energy to atomizers with different characteristic parameters, so that the battery device of the electronic cigarette can be adapted to atomizers with different specifications, to thereby improve the adaptation range of the electronic cigarette.

Figure 5:
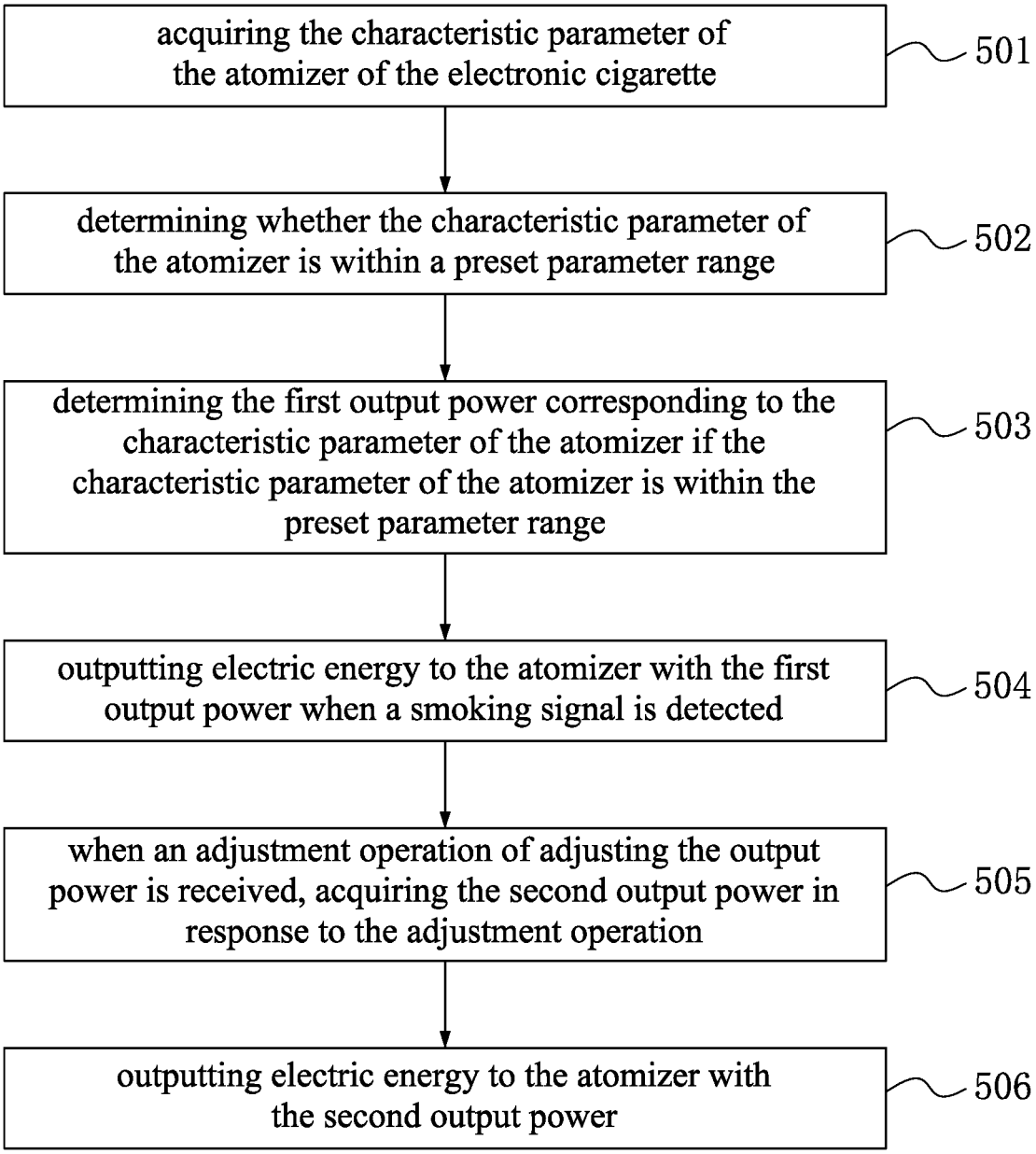
FIG. 5 is a flowchart of an electronic cigarette control method according to an embodiment of the present invention.

Referring to FIG. 5, it shows a flowchart of an electronic cigarette control method according to an embodiment of the present invention. In this embodiment, the electronic cigarette control method is used in the electronic cigarette shown in FIG. 1 as an example. As shown in FIG. 5, the electronic cigarette control method may include:

Step 501: acquiring the characteristic parameter of the atomizer of the electronic cigarette.

The electronic cigarette can detect whether an atomizer is connected to the battery device of the electronic cigarette through a detection device, wherein the detection device may be any one of a pressure sensor and a magnetic induction IC.

Figure 6:
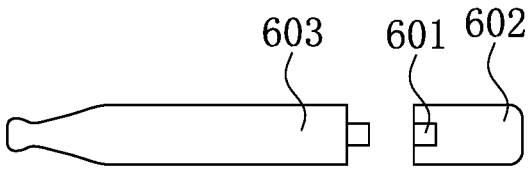
FIG. 6 is a schematic diagram of a connection between an atomizer and a battery device according to the embodiment shown in FIG. 5.

Referring to FIG. 6, it illustrates a connection diagram of an atomizer 603 and a battery device 602 according to an embodiment of the present invention. As shown in FIG. 6, the battery device 602 is provided with a pressure sensor 601, and the pressure sensor 601 is provided at the connecting position between the battery device 602 and the atomizer 603. After the atomizer 603 is connected with the battery device 602, the atomizer 603 will generate a certain pressure on the pressure sensor 601. When the battery device 602 detects whether the atomizer 603 is connected, the MCU in the battery device 602 can receive the sensing value detected by the pressure sensor 601. When the sensing value detected by the pressure sensor 601 meets a preset condition, for example, if the sensing value is greater than a pressure threshold, the MCU of the electronic cigarette determines that an atomizer is connected to the electronic cigarette.

After the electronic cigarette detects that the atomizer is connected, the electronic cigarette starts to acquire the characteristic parameter of the atomizer.

The method of acquiring the characteristic parameter of the atomizer is similar to step 301, which is not repeated in this embodiment.

For example, after the electronic cigarette identifies the resistance type of the heating element of the atomizer, the electronic cigarette displays the resistance type on the display screen; when an operation for resetting the resistance type is received, the electronic cigarette displays an interface for resetting the resistance type of the heating element of the atomizer; the electronic cigarette acquires the new resistance type that is reset in the interface for resetting the resistance type of the heating element of the atomizer; and the electronic cigarette replaces the resistance type of the heating element of the atomizer with the new resistance type.

Optionally, the electronic cigarette firstly acquires the resistivity of the heating element of the atomizer, and then compares the acquired resistivity of the heating element of the atomizer with a table of the resistance type of the heating element of the atomizer pre-stored in the MCU corresponding to the resistivity of the heating element of the atomizer, to thereby get the resistance type of the heating element of the atomizer corresponding to the acquired resistivity and feed it back to the MCU. The electronic cigarette displays the resistance type of the heating element of the atomizer on the display screen of the electronic cigarette. The user can judge whether the resistance type of the heating element of the atomizer displayed on the display screen is the same as the actual resistance type of the heating element of the atomizer.

Figure 7:
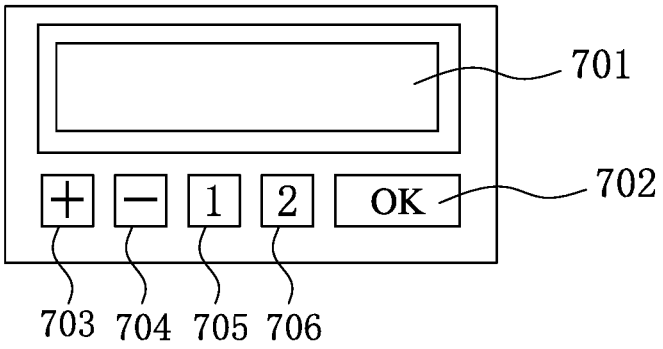
FIG. 7 is a schematic structural diagram of a display screen of the electronic cigarette with the keys according to the embodiment shown in FIG. 5.

Referring to FIG. 7, it is a schematic structural diagram of a display screen of the electronic cigarette with the keys according to an embodiment of the present invention. The display screen 701 can display the content to be displayed, such as the resistance type of the heating element of the atomizer, the atomizer type, and the like. The bottom of the display screen 701 includes at least a physical key, which is shown in FIG. 7 as a key 702 (OK key), a key 703 ([+] key), a key 704 ([−] key), a key 705 ([1] key), and a key 706 ([2] key).

As a possible implementation manner, the electronic cigarette detects the resistance type of the heating element of the atomizer, and the electronic cigarette controls the display screen to display the resistance type of the heating element of the atomizer. The user can observe and judge whether the resistance type of the heating element of the atomizer displayed on the display screen is the same as the actual resistance type of the heating element of the atomizer connected to the electronic cigarette. If the user judges that the resistance types are the same, the user can manually press the [OK] key (i.e., key 702) to confirm that the electronic cigarette has identified the correct resistance type of the heating element of the atomizer.

As another possible implementation manner, the electronic cigarette detects the resistance type of the heating element of the atomizer, and the electronic cigarette controls the display screen to display the resistance type of the heating element of the atomizer. The user can observe and judge whether the resistance type of the heating element of the atomizer displayed on the display screen is the same as the actual resistance type of the heating element of the atomizer connected to the electronic cigarette. If the user judges that the resistance types are not the same, the user can manually press the [1] key (i.e., key 705). After the MCU gets this signal, it controls the display screen 701 to display an interface for selecting the resistance type of the heating element of the atomizer, wherein this interface displays various selectable resistance types. The user can select the correct resistance type of the heating element of the atomizer by using the [+] key (key 703) or the [−] key (key 704), and the correct resistance type of the heating element of the atomizer is fed back to the MCU through the [OK] key (key 702).

For example, assuming that the resistance type of the heating element of the atomizer detected by the electronic cigarette is a Notch Coil type. If the user observes and judges that the resistance type of the heating element of the atomizer displayed on the display screen is not the same as the actual resistance type of the heating element of the atomizer, then the user can press the [1] key, the display screen enters an interface for selecting the resistance type of the heating element of the atomizer, and the user can select the resistance type of the heating element of the atomizer by manually pressing the [+], [−] keys, and then press the [OK] key to get the correct resistance type of the heating element of the atomizer.

It should be noted that the above solution only takes the selection of the resistance type of the heating element of the atomizer through the keys as an example. In actual implementations, the resistance type or the atomizer type can also be selected by other solutions, for example, through a touch screen to select the resistance type of the heating element of the atomizer or the atomizer type, which is not limited in this embodiment.

Step 502: determining whether the characteristic parameter of the atomizer is within a preset parameter range.

In a possible implementation manner, after an atomizer is connected to the battery device of the electronic cigarette and the electronic cigarette has acquired the characteristic parameter of the atomizer, the electronic cigarette can determine whether the characteristic parameter of the atomizer is within a preset parameter range, wherein the preset parameter range may be a parameter range of the characteristic parameter of the heating element of the atomizer supported by the battery device of the electronic cigarette; if the characteristic parameter of the atomizer is within the parameter range, then the electronic cigarette performs the above step of determining the first output power corresponding to the characteristic parameter of the atomizer.

Specifically, when detecting the characteristic parameter of the atomizer, the electronic cigarette compares the characteristic parameter of the atomizer with a first preset value and a second preset value of each characteristic parameter pre-stored in the MCU, wherein the first preset value is the maximum value of the preset parameter range, and the second preset value is the minimum value of the preset parameter range. When the characteristic parameter detected by the electronic cigarette is greater than the second preset value and smaller than the first preset value, the electronic cigarette can control the battery device to output electric energy to the atomizer with the first output power.

For example, taking the characteristic parameter including the resistance value of the heating element of the atomizer as an example, if the resistance value of the heating element of the atomizer that the electronic cigarette can match is in the range of 0.1 to 1, then the second preset value is the minimum value of 0.1 and the first preset value is the maximum value of 1 in the range. If the electronic cigarette detects that the resistance value of the heating element of the atomizer is 0.25, then the MCU compares the detected resistance value of the heating element of the atomizer with the pre-stored first and second preset values. The MCU determines that the detected resistance value of the heating element of the atomizer is greater than the second preset value of 0.1 and smaller than the first preset value of 1, and the MCU will then perform the step of determining the first output power corresponding to the characteristic parameter of the atomizer.

Optionally, when the characteristic parameter of the atomizer is greater than the preset parameter range, the electronic cigarette displays a first prompt message to indicate that the atomizer does not match the battery device of the electronic cigarette; when the characteristic parameter of the atomizer is smaller than the preset parameter range, the electronic cigarette displays a second prompt message to indicate that the atomizer is not installed correctly.

Specifically, when detecting the characteristic parameter of the atomizer, the electronic cigarette compares the characteristic parameter of the atomizer with a first preset value and a second preset value of each characteristic parameter pre-stored in the MCU, wherein the first preset value is the maximum value of the preset parameter range, and the second preset value is the minimum value of the preset parameter range. When the characteristic parameter detected by the electronic cigarette is greater than the first preset value, the MCU of the electronic cigarette can control the display screen to display a prompt message "the atomizer does not match the battery device of the electronic cigarette"; when the characteristic parameter detected by the electronic cigarette is less than the second preset value, the MCU of the electronic cigarette can control the display screen to display a prompt message "the atomizer is not installed correctly or may be damaged".

In actual implementations, the specific values of the first preset value and the second preset value may be default values in the electronic cigarette or customized by the user, which is not limited in this embodiment.

For example, taking the characteristic parameter including the resistance value of the heating element of the atomizer as an example, if the resistance value of the heating element of the atomizer that the electronic cigarette can match is in the range of 0.1 to 1, then the second preset value is the minimum value of 0.1 and the first preset value is the maximum value of 1 in the range.

As a possible implementation situation, if the electronic cigarette detects that the resistance value of the heating element of the atomizer is 0.05, the MCU compares the detected resistance value of the heating element of the atomizer with the pre-stored first and second preset values, and the MCU determines that the detected resistance value of the heating element of the atomizer is smaller than the second preset value of 0.1, then the MCU controls the display screen to display the second prompt message "the atomizer is not installed correctly or may be damaged".

As another possible implementation situation, if the electronic cigarette detects that the resistance value of the heating element of the atomizer is 1.1, the MCU compares the detected resistance value of the heating element of the atomizer with the pre-stored first and second preset values, and the MCU determines that the detected resistance value is greater than the first preset value of 1, then the MCU controls the display screen to display the first prompt message "the atomizer does not match the battery device of the electronic cigarette".

Optionally, in a possible implementation situation, when the characteristic parameter of the atomizer is smaller than the preset parameter range, the electronic cigarette may also display the first prompt message to remind the user that the atomizer does not match the battery device of the electronic cigarette. For example, if the electronic cigarette detects that the resistance value of the heating element of the atomizer is 0.05, the MCU compares the detected resistance value of the heating element of the atomizer with the pre-stored range of resistance value (e.g., 0.1 to 1), and determines that the detected resistance value of the heating element of the atomizer is smaller than 0.1, then the MCU controls the display screen to display the first prompt message "the atomizer does not match the battery device of the electronic cigarette".

The above only takes the electronic cigarette to control the display screen to display prompt message as an example. In actual implementations, the electronic cigarette can also issue alarms, for example, a reminding sound of "Di, Di, Di", which is not limited in this embodiment.

Step 503: determining the first output power corresponding to the characteristic parameter of the atomizer if the characteristic parameter of the atomizer is within the preset parameter range.

The method of determining the first output power corresponding to the characteristic parameter of the atomizer is similar to step 302, which is not repeated in this embodiment.

Step 504: outputting electric energy to the atomizer with the first output power when a smoking signal is detected.

The electronic cigarette determines the first output power through the MCU, and controls the atomizer in the electronic cigarette to generate smoke with the first output power, wherein the method of outputting the first output power to the atomizer is similar to step 303, which is not repeated in this embodiment.

Step 505: when an adjustment operation of adjusting the output power is received, acquiring the second output power in response to the adjustment operation.

Step 506: outputting electric energy to the atomizer with the second output power.

Optionally, the user can manually adjust the output power. For example, taking FIG. 6 as an example, when the user wants to increase the output power, the user can press the [+] key twice, and when the user wants to decrease the output power, the user can press the [−] key twice. If the electronic cigarette detects that the [+] key is pressed twice, the MCU controls the display screen to display a prompt message of whether to increase the output power. After the user presses the [OK] key, then each time the [+] key is pressed, the MCU controls the display screen to display that the output power is increased by one unit (e.g., 1 W). When the displayed value of output power reaches the second output power desired by the user, the user presses the [OK] key, and the MCU controls the power control circuit to output power to the atomizer with the second output power. Correspondingly, if the electronic cigarette detects that the [−] key is pressed twice, the MCU controls the display screen to display a prompt message of whether to decrease the output power. After the user presses the [OK] key, then each time the [−] key is pressed, the MCU controls the display screen to display that the output power is decreased by one unit (e.g., 1 W). When the displayed value of output power reaches the second output power desired by the user, the user presses the [OK] key, and the MCU controls the power control circuit to output power to the atomizer with the second output power.

For example, when the electronic cigarette detects that the resistance value of the heating element of a notch coil type atomizer is 0.75Ω, the MCU determines, through query, that the first output power of the atomizer should be 30W according to the relationship between the resistance value of the heating element of the atomizer and the output power. Then, 30W, as the first output power, is outputted to the atomizer.

As a possible implementation manner, when the user presses the [+] key twice, the MCU receives the input signal, determines that the user wants to increase the output power of the atomizer, and controls the display screen to display the prompt message "increase the output power?". If the user presses the [OK] key, the MCU determines to start increasing the output power. When the user presses the [+] key once, the MCU increases the output power by 1 W, and controls the display screen to display the increased output power. After the second output power reaches 35 W desired by the user, the user presses the [OK] key, and the MCU controls the power control circuit to output power to the atomizer with the second output power of 35 W.

As another possible implementation manner, when the user presses the [−] key twice, the MCU receives the input signal, determines that the user wants to decrease the output power of the atomizer, and controls the display screen to display the prompt message "decrease the output power?". If the user presses the [OK] key, the MCU determines to start decreasing the output power. When the user presses the [−] key once, the MCU decreases the output power by 1 W, and controls the display screen to display the decreased output power. After the second output power reaches 25 W desired by the user, the user presses the [OK] key, and the MCU controls the power control circuit to output power to the atomizer with the second output power of 25 W.

The above only takes controlling the output power of the electronic cigarette through the keys as an example. In actual implementations, the output power of the electronic cigarette can also be selected by other solutions, for example, the output power required by the user can be inputted through a touch screen, or can also be customized by the user through the APP in the mobile terminal and then sent to the electronic cigarette, which is not limited in this embodiment.

Optionally, the electronic cigarette sets the second output power as the new first output power corresponding to the characteristic parameter of the atomizer.

After the user selects a suitable second output power, the MCU sets the second output power as the new first output power corresponding to the characteristic parameter of the atomizer. When the user uses an atomizer with the same characteristic parameter to connect to the battery device of the electronic cigarette, the electronic cigarette will output electric energy to the atomizer with the new first output power.

For example, assuming that the first output power of a notch coil type atomizer with a resistance value of the heating element being 0.75Ω is 30W, the second output power after adjustment by the user is 35W. The MCU replaces the first output power of 30W corresponding to the resistance value 0.75Ω of the heating element of the atomizer with the second output power 35W as the new first output power, and stores the new first output power of 35W in the MCU. When the user uses a notch coil type atomizer with a resistance value of the heating element being 0.75Ω to connect to the electronic cigarette, the electronic cigarette will output electric energy to the atomizer with the new first output power of 35W.

In another possible implementation manner, the electronic cigarette can count the adjustment operations of the output power of the atomizer corresponding to the characteristic parameter within a preset period of time, and set the new first output power corresponding to the characteristic parameter of the atomizer according to the counted adjustment operations of the output power. The preset time period may be a preset length of time period before the current time, such as one month or one year before the current time.

Specifically, among the second output powers corresponding to the output power adjustment operations of the atomizer according to the characteristic parameter, the output power being adjusted most times in a preset period of time can be set as the new first output power. Optionally, among the second output powers corresponding to the output power adjustment operations of the atomizer according to the characteristic parameter, the output power with the longest use time in a preset period of time can be set as the new first output power.

As a possible implementation manner, the user adjusts the output power of an atomizer with a certain characteristic parameter several times, the MCU records each second output power as being adjusted by each adjustment, counts the number of times each second output power is adjusted, and sets the second output power adjusted by the user with the most times as the new first output power of the atomizer corresponding to the characteristic parameter.

For example, if the user uses a Notch Coil type atomizer with a resistance value 0.75Ω, of the heating element, the first output power is 30W, the MCU detects that the user adjusts the output power to 34W four times and the user adjusts the output power to 36W six times, then the MCU selects the second output power 36W being adjusted by the user with the most times as the new first output power of the atomizer, and it is stored in the MCU. When the user uses a notch coil type atomizer with a resistance value of the heating element being 0.75Ω to connect to the electronic cigarette, the electronic cigarette will output electric energy to the atomizer with the new first output power of 36W.

As another possible implementation manner, the user adjusts the output power of an atomizer with a certain characteristic parameter several times, the MCU records each second output power as being adjusted by each adjustment and the use time of each second output power, and sets the second output power with the longest use time by the user as the new first output power of the atomizer corresponding to the characteristic parameter.

For example, if the user uses a Notch Coil type atomizer with a resistance value 0.75Ω, of the heating element, the first output power is 30W, the MCU detects that the total use time is 4 minutes when the output power is adjusted to 34W and the total use time is 6 hours when the output power is adjusted to 36W, then the MCU selects the output power 36W with the longest use time by the user as the new first output power of the Notch Coil type atomizer with a resistance value 0.75Ω of the heating element. When the user uses a notch coil type atomizer with a resistance value of the heating element being 0.75Ω to connect to the electronic cigarette, the electronic cigarette will output electric energy to the atomizer with the new first output power of 36W.

In conclusion, in the electronic cigarette control method provided in this embodiment, by acquiring the characteristic parameter of the atomizer in the electronic cigarette, the output power of electric energy outputted to the atomizer is determined according to the relationship between the characteristic parameter of the atomizer and the output power, and then the determined output power of electric energy is outputted to the atomizer. That is, the electronic cigarette can output different power of electric energy to atomizers with different characteristic parameters, so that the battery device of the electronic cigarette can be adapted to atomizers with different specifications, to thereby improve the adaptation range of the electronic cigarette.

Further, in the electronic cigarette control method provided in this embodiment, the user can adjust the output power autonomously during the smoking of the electronic cigarette by the user. When the user installs the same atomizer again, the electronic cigarette will the new first output power, so as to provide appropriate output power based on the user's usage habits.

Figure 8:
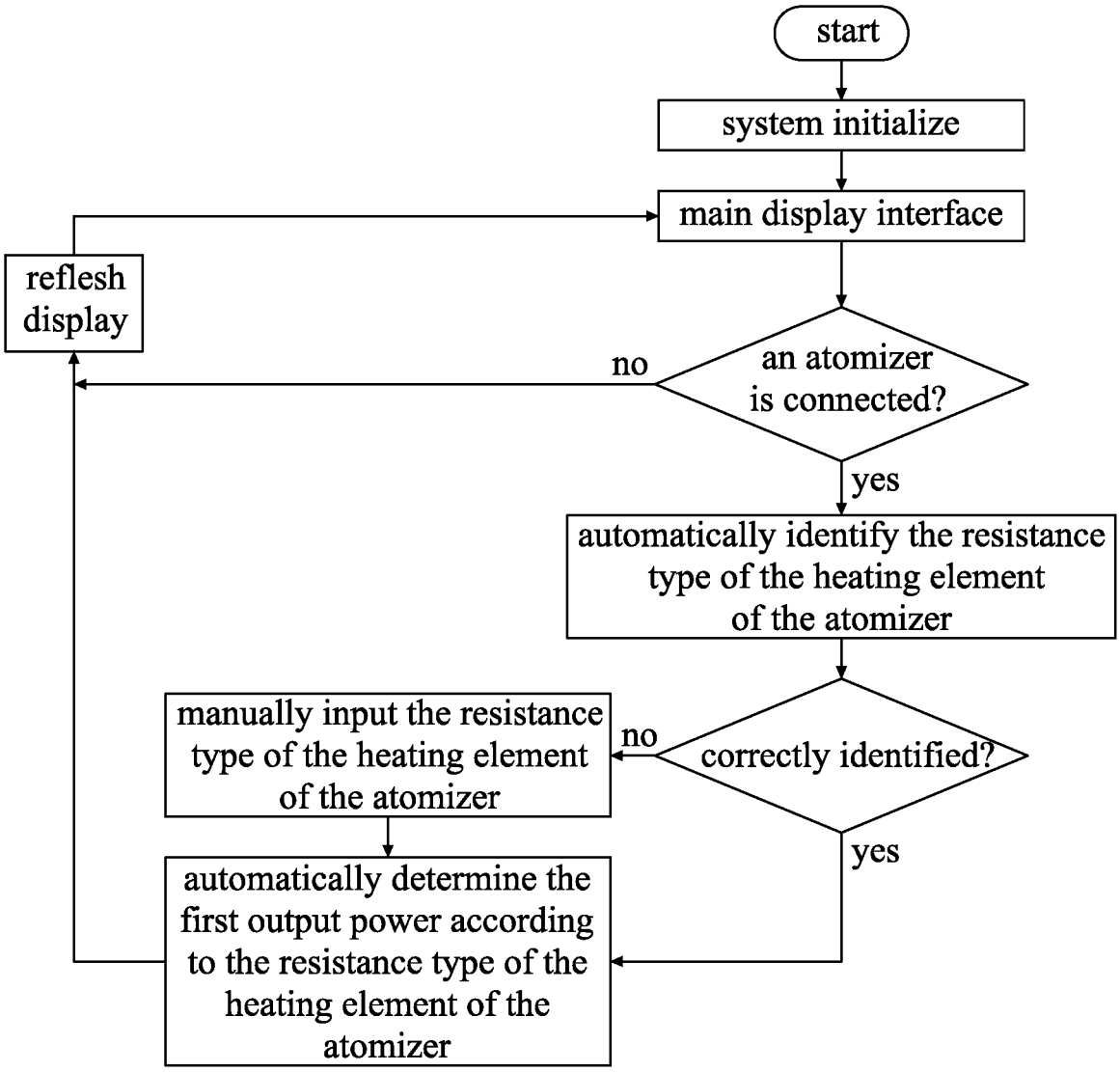
FIG. 8 is a flowchart of an electronic cigarette control method according to an embodiment of the present invention.

FIG. 8 is a flowchart of an electronic cigarette control method according to an embodiment of the present invention. In FIG. 8, after the electronic cigarette is turned on, the electronic cigarette starts to initialize. The pressure sensor of the electronic cigarette detects whether an atomizer is connected. When the pressure sensor of the electronic cigarette detects the change of pressure, the electronic cigarette determines that the user has installed the atomizer. By detecting the characteristic parameter of the atomizer, the electronic cigarette automatically identifies the resistance type of the heating element of the atomizer, and the user judges whether the resistance type of the heating element of the atomizer is correctly identified. If the resistance type of the heating element of the atomizer is correctly identified, the electronic cigarette automatically determines the first output power according to the resistance type of the heating element of the atomizer. If the resistance type of the heating element of the atomizer is incorrectly identified, the user can manually input the resistance type of the heating element of the atomizer, and the electronic cigarette automatically determines the first output power according to the resistance type of the heating element of the atomizer. Then, the first output power and related parameters of the atomizer are refreshed and displayed on the main display interface.

Figure 9:
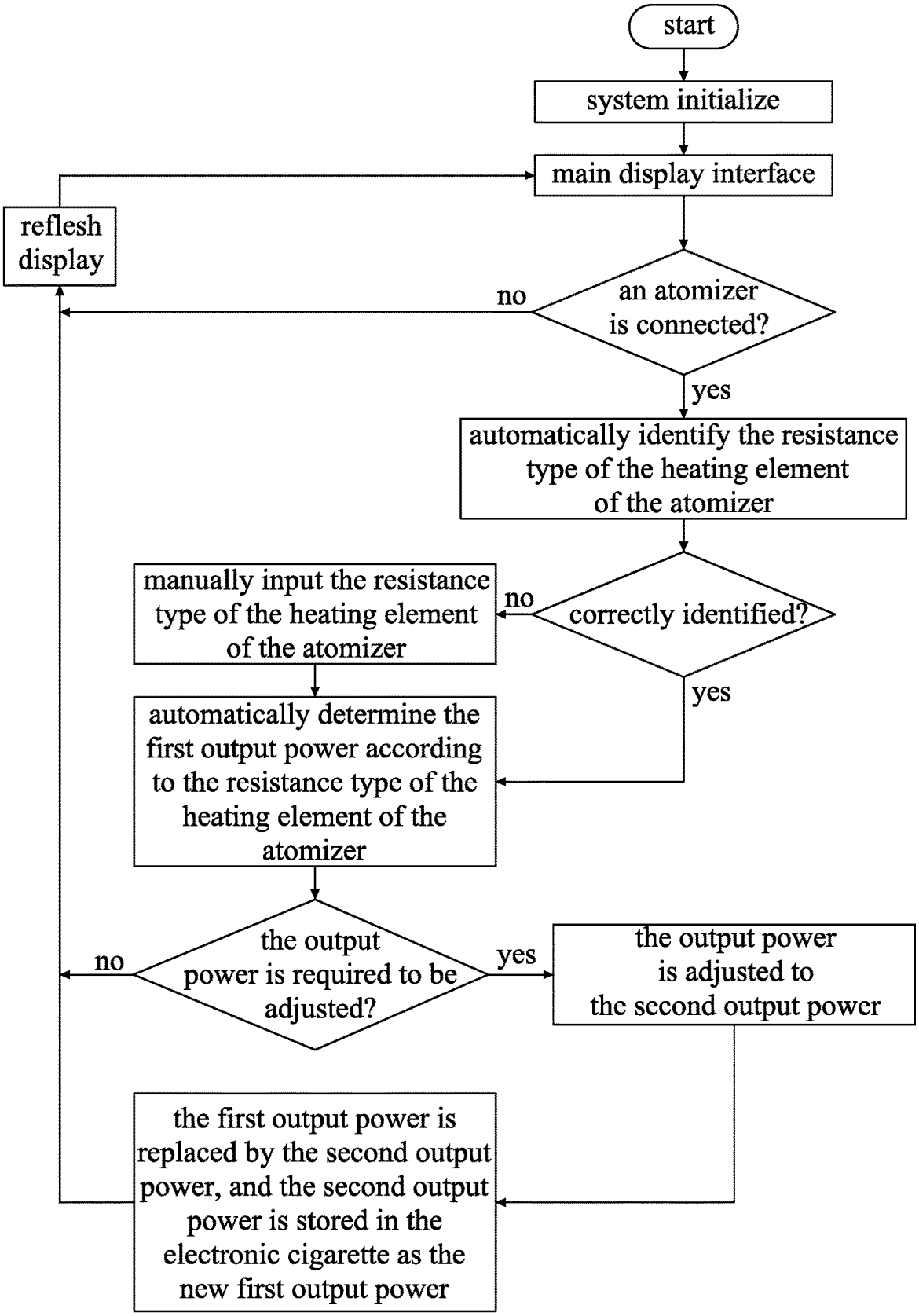
FIG. 9 is a flowchart of an electronic cigarette control method according to an embodiment of the present invention.

FIG. 9 is a flowchart of an electronic cigarette control method according to an embodiment of the present invention. In FIG. 9, the first output power is automatically matched and determined by the electronic cigarette according to the resistance type of the heating element of the atomizer. The user judges whether the output power is required to be adjusted. When the output power is required to be adjusted, the user increases or decreases the output power through an input module to the second output power, and after adjustment, the first output power is replaced by the second output power and stored in the electronic cigarette as the new first output power. When an atomizer of the same type is connected to the electronic cigarette next time, the new first output power is outputted to the atomizer. Then, the first output power and related parameters of the atomizer are refreshed and displayed on the main display interface.

Figure 10:
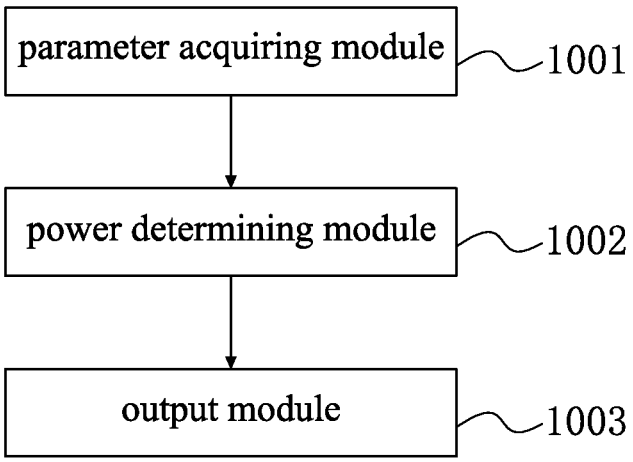
FIG. 10 is a schematic structural diagram of an electronic cigarette according to an embodiment of the present invention.

Referring to FIG. 10, it shows a schematic diagram of an electronic cigarette according to an embodiment of the present invention. As shown in FIG. 10, the electronic cigarette may include:

a parameter acquiring module 1001, configured to acquire the characteristic parameter of the atomizer of the electronic cigarette;

a power determining module 1002, configured to determine the first output power corresponding to the characteristic parameter of the atomizer;

an output module 1003, configured to output electric energy to the atomizer with the first output power when a smoking signal is detected.

Optionally, the characteristic parameter includes at least one of: the atomizer type, the liquid inlet amount of the atomizer, the air inlet amount of the atomizer, the resistance type of the heating element of the atomizer, and the resistance value of the heating element of the atomizer.

Optionally, when the characteristic parameter includes the atomizer type and a first parameter, the parameter acquiring module is configured to receive an input of the atomizer type and then query the first parameter according to the relationship between the atomizer type and the first parameter, wherein the first parameter includes at least one of: the liquid inlet amount of the atomizer, the air inlet amount of the atomizer, the resistance type of the heating element of the atomizer, and the resistance value of the heating element of the atomizer.

Optionally, when the characteristic parameter includes the resistance type of the heating element of the atomizer and the resistance value of the heating element of the atomizer, the parameter acquiring module is configured to identify the resistance type of the heating element of the atomizer and measure the resistance value of the heating element of the atomizer.

Optionally, when identifying the resistance type of the heating element of the atomizer, the parameter acquiring module is configured to firstly measure the resistivity of the heating element of the atomizer, and then determine the resistance type of the heating element of the atomizer based on the measured resistivity according to the preset relationship between the resistivity and the resistance type.

Optionally, the electronic cigarette further includes:

a first display module, configured to display the resistance type of the heating element after the resistance type of the heating element of the atomizer is identified;

a second display module, configured to display an interface for resetting the resistance type of the heating element of the atomizer when an operation for resetting the resistance type is received;

a type acquiring module, configured to acquire the new resistance type that is reset in the interface for resetting the resistance type of the heating element of the atomizer; and a replacing module, configured to replace the resistance type of the heating element of the atomizer with the new resistance type.

Optionally, the electronic cigarette further includes:

a power acquiring module, configured for acquiring the second output power corresponding to the adjustment operation when an adjustment operation of adjusting the output power is received.

The output module is further configured for outputting electric energy to the atomizer with the second output power acquired by the power acquiring module.

Optionally, the electronic cigarette further includes:

a first setting module, configured to set the second output power as the new first output power corresponding to the characteristic parameter of the atomizer.

Optionally, the electronic cigarette further includes:

an operation counting module, configured to count the adjustment operations of the output power of the atomizer corresponding to the characteristic parameter within a preset period of time;

and a second setting module, configured to set the new first output power corresponding to the characteristic parameter of the atomizer according to the adjustment operations counted by the operation counting module.

Optionally, the electronic cigarette further includes:

a judging module, configured for determining whether the characteristic parameter of the atomizer is within a preset parameter range before the power determining module determines the first output power corresponding to the characteristic parameter of the atomizer.

The power determining module is configured to perform the step of determining the first output power corresponding to the characteristic parameter of the atomizer when the characteristic parameter of the atomizer is within the preset parameter range.

In conclusion, in the electronic cigarette provided in this embodiment, by acquiring the characteristic parameter of the atomizer in the electronic cigarette, the output power of electric energy outputted to the atomizer is determined according to the relationship between the characteristic parameter of the atomizer and the output power, and then the determined output power of electric energy is outputted to the atomizer. That is, the electronic cigarette can output different power of electric energy to atomizers with different characteristic parameters, so that the battery device of the electronic cigarette can be adapted to atomizers with different specifications, to thereby improve the adaptation range of the electronic cigarette.

Further, in the electronic cigarette provided in this embodiment, the user can adjust the output power autonomously during the smoking of the electronic cigarette by the user. When the user installs the same atomizer again, the electronic cigarette will the new first output power, so as to provide appropriate output power based on the user's usage habits.

It should be noted that the electronic cigarette provided in the above-mentioned embodiment is described by taking only the division of the above functional modules as an example. In practice, the above functions may be allocated by different functional modules according to needs, that is, the internal structure of the server is divided into different functional modules to complete all or part of the functions described above. In addition, the electronic cigarette and the electronic cigarette control method provided in the foregoing embodiments belong to the same concept, and the specific implementation thereof can refer to the method embodiment, and details are not described herein again.

The present invention further provides an electronic cigarette control device. The control device includes: a memory and a processor; the memory stores at least one instruction; and by loading and executing the at least one instruction, the processor performs the above electronic cigarette control method.

The present invention further provides a computer-readable storage medium. The computer-readable storage medium stores one or more instructions, and when the one or more instructions are executed by a processor in an electronic cigarette, the above electronic cigarette control method is performed.

Those of ordinary skill in the art may understand that all or part of the steps for implementing the foregoing embodiments may be implemented by hardware, or may be implemented by a program to instruct related hardware. The program may be stored in a computer-readable storage medium. The storage medium mentioned may be a read-only memory, a magnetic disk or an optical disk.

The above are only preferred embodiments of the present invention and are not intended to limit the present invention. Any modification, equivalent replacement, or improvement made within the principle of the present invention shall be included in the protection scope of the present invention.

What is claimed is:

1. An electronic cigarette control method for controlling an output power being outputted to a heating element of an atomizer of an electronic cigarette, comprising:

after the atomizer is connected to a battery device of the electronic cigarette, an MCU of the electronic cigarette reading characteristic parameter of the atomizer stored in a memory of the atomizer, wherein the characteristic parameter comprises at least one of: atomizer type of the atomizer, liquid inlet amount of the atomizer, air inlet amount of the atomizer, resistance type of the heating element of the atomizer, and resistance value of the heating element of the atomizer;

the MCU of the electronic cigarette determining a first output power corresponding to the characteristic parameter of the atomizer; and the battery device of the electronic cigarette outputting electric energy to the heating element of the atomizer with the first output power when a smoking signal of lighting up the electronic cigarette triggered by a user is detected by the electronic cigarette.

2. The method according to claim 1, further comprising:

when an adjustment operation of adjusting the output power is received, acquiring a second output power in response to the adjustment operation; and outputting electric energy to the atomizer with the second output power.

3. The method according to claim 2, further comprising:

setting the second output power as a new first output power corresponding to the characteristic parameter of the atomizer.

4. The method according to claim 2, further comprising:

counting the adjustment operations of the output power of the atomizer corresponding to the characteristic parameter within a preset period of time; and setting a new first output power corresponding to the characteristic parameter of the atomizer according to the counted adjustment operations.

5. The method according to claim 1, wherein before determining the first output power corresponding to the characteristic parameter of the atomizer, the method further comprises:

determining whether the characteristic parameter of the atomizer is within a preset parameter range; and determining the first output power corresponding to the characteristic parameter of the atomizer if the characteristic parameter of the atomizer is within the preset parameter range.

6. An electronic cigarette control device, comprising:

a memory and a processor;

wherein the memory stores therein at least one instruction; and the processor, by loading and executing the at least one instruction, implements the electronic cigarette control method according to claim 1.

7. A computer-readable storage medium stored with at least one instruction therein, wherein when the at least one instruction is executed by a processor of an electronic cigarette, the electronic cigarette control method according to claim 1 is implemented.

* * * * *